United States Patent [19]

Hacker et al.

[11] 4,417,850

[45] Nov. 29, 1983

[54] VERTICAL COLUMN PUMP

[75] Inventors: Richard K. Hacker, West Allis; James F. Tesch, New Berlin, both of Wis.

[73] Assignee: Allis-Chalmers Corporation, Milwaukee, Wis.

[21] Appl. No.: 451,555

[22] Filed: Dec. 20, 1982

[51] Int. Cl.[3] ..... F04D 13/00

[52] U.S. Cl. ..... 415/142; 415/118; 415/170 R; 415/213 C; 417/360; 417/424

[58] Field of Search ..... 415/142, 213 C, 118, 415/201, 170 R; 417/360, 361, 424

[56] References Cited

U.S. PATENT DOCUMENTS

| | | | |
|---|---|---|---|
| 1,234,948 | 7/1917 | Sperry | 415/201 |
| 3,079,865 | 3/1963 | Lipe | 415/201 |
| 4,073,606 | 2/1978 | Eller | 417/424 |

*Primary Examiner*—John W. Shepperd
*Assistant Examiner*—John Kwon
*Attorney, Agent, or Firm*—Timothy R. Conrad

[57] ABSTRACT

A vertical column hydraulic pump is disclosed having an impeller secured to a vertical rotary shaft within a water passageway. A diffuser surrounds the shaft adjacent the impeller. The pump is provided with a first bearing surrounding the shaft adjacent the impeller and a second bearing surrounding the shaft adjacent a shaft coupling. Means are provided to raise the shaft to present a gap at the coupling through which the second bearing may be removed. A bearing cartridge is provided secured to the top of the diffuser and extending downwardly to the first bearing, the first bearing is secured to the cartridge. The cartridge may be lifted to expose the first bearing whereby the first bearing may be removed through the gap without the need to remove the pump impeller from the shaft.

6 Claims, 8 Drawing Figures

VERTICAL COLUMN PUMP

BACKGROUND OF THE INVENTION

1. Field of the Invention

This invention relates to vertical column hydraulic pumps and more particularly it relates to means for supporting bearings which support the shaft of the pumps and means for facilitating removal and replacement of the bearings.

2. Description of the Prior Art

Vertical column pumps, as shown in U.S. Pat. No. 4,073,606 to Eller dated Feb. 14, 1978, are well known for pumping water from a sump. Such pumps are axial flow and continuously primed. That is, the pump is designed so the pump impeller is constantly below the normal water level in a sump. Normally, the pump is designed so the normal water level just reaches the top of the impeller.

Such pumps have long shafts extending through a water passageway formed by a pump casing. It is known to be desirable to support the shaft with bearings at intermediate locations within the passageway and particularly it is desirable to provide the shaft with a bearing located as close to the impeller as possible.

Through operation of the pump, the shaft supporting bearings naturally wear and require repair or replacement from time to time. However, prior art pumps presented several problems in bearing maintenance.

The bearing located near the impeller is supported on the bottom of a diffuser housing adjacent the impeller. Removal of the bearing required removal of the impeller. This required a time consuming and cumbersome process to dewater the sump. Additionally, intermediate bearings had to be axially split bearings which are more costly and possess shorter lives than solid cylindrical bearings.

OBJECTS AND SUMMARY OF THE INVENTION

It is an object of the invention to provide a pump installation having a shaft bearing adjacent the pump impeller which may be replaced without requiring removal of the impeller.

It is a further object of the present invention to provide a pump installation with a solid intermediate shaft bearing which is readily replaceable.

According to a preferred embodiment of the present invention, a vertical column hydraulic pump installation is disclosed having an impeller carried by a rotary shaft. A diffuser surrounds the shaft adjacent the impeller. The shaft is separable into an upper and lower portion by means of a coupling. A first bearing cartridge is removably secured to the top of the diffuser and extends downwardly surrounding the shaft toward the impeller. A first bearing is secured to the first cartridge adjacent the impeller.

A second bearing cartridge is secured to the top of the diffuser and extends upwardly to a free end surrounding the lower shaft portion adjacent the coupling. A second bearing is secured to the free end.

Means are provided to permit raising of the upper shaft portion to present a gap between the upper and lower shaft portions with the gap having an axial dimension greater than the axial dimensions of the first and second bearings.

With the upper shaft portion raised, the second out of the diffuser. Once out of the diffuser, the first bearing cartridge can be removed and the first bearing can be moved along the shaft and removed through the gap.

DESCRIPTION OF THE PREFERRED EMBODIMENT

Figure 1:
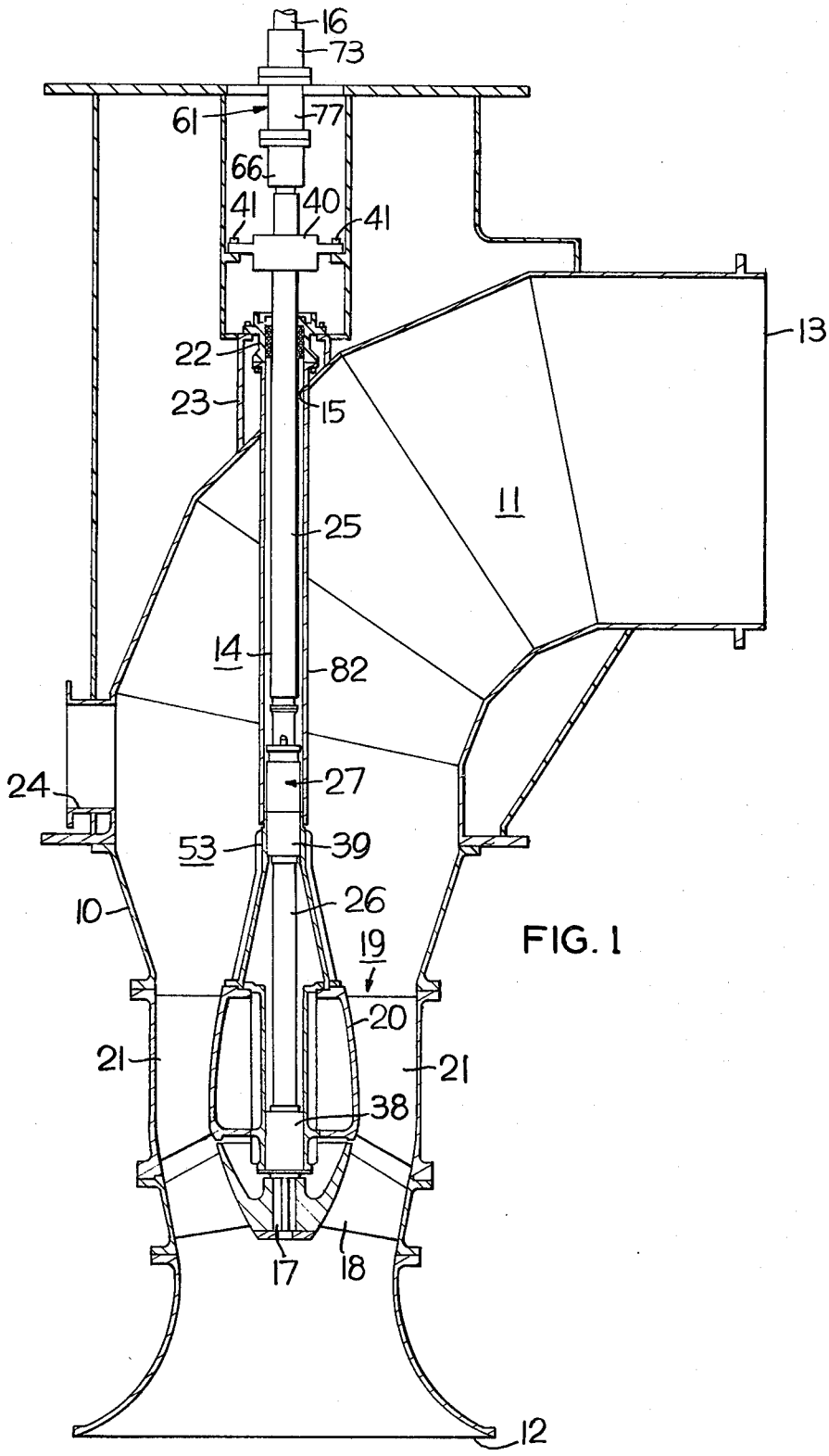
FIG. 1 is a side view of a vertical column hydraulic pump installation according to the present invention.

Referring to FIG. 1, a vertical column hydraulic pump installation is shown having an elbow-shaped pump casing 10 defining an elbow-shaped water passageway 11 extending initially vertically from an inlet or sump end 12 to a discharge end 13. A vertical shaft 14 is provided within the water passageway 11 and extends upwardly through an opening 15 in the casing 10. An upper end 16 of shaft 14 is operably connected to a pump motor (not shown) operable to rotate shaft 14 about its axis. A lower or free end 17 of shaft 14 is provided with an impeller 18 secured to the shaft for rotation therewith. A diffuser 19 is provided comprising a housing 20 surrounding the shaft 14 directly above the impeller 18 and in spaced relation to the shaft. The housing 20 is supported by a plurality of diffuser vanes 21 extending from the housing 20 and secured to the pump casing 10. A stuffing box 22 surrounds the shaft 14 in sealing engagement outside of the passageway 11 and is removably secured to a stuffing box brace 23 secured to the casing 10. A manhole 24 is provided extending through casing 10 permitting access to passageway 11 above diffuser 19.

The shaft 14 is separable into a first or upper portion 25 and a second or lower portion 26 by means of an intermediate coupling 27 located on the shaft 14 within the passageway 11. As shown more fully in FIG. 2, the upper shaft portion 25 terminates at a lower free end 28 having an axially projecting flanged hub 29. Likewise, lower shaft portion 26 is provided at an upper free end 30 with an axially projecting flanged hub 31 abutting hub 29. A split ring 32 having a notched inner cylindrical surface joins hub 29 and hub 31 thereby permitting transfer of axial loads between upper shaft 25 and lower shaft 26. Ring 32 is axially split to permit removal of the ring and separation of the upper and lower shaft portions.

Coupling 27 further includes a coupling sleeve 33 surrounding the lower end 28 of upper shaft 25, split ring 32 and the upper end 30 of lower shaft 26. Sleeve 33 is keyed to upper shaft 25 and lower shaft 26 by means of keyways 34 and 35 respectively with sleeve 33 acting to transmit rotational forces between upper shaft 25 and lower shaft 26. Sleeve 33 is provided with a circumferential notch 36. Likewise, upper shaft 25 is provided with a circumferential notch 37 above sleeve 33 a distance greater than a distance sleeve 33 extends below upper shaft 25.

As shown in FIG. 1, the installation is provided with three bearings surrounding shaft 14. A lower first bearing 38 is provided surrounding lower shaft portion 26 adjacent to impeller 18. An intermediate second bearing 39 surrounds lower shaft portion 26 beneath coupling 27. Bearings such as first bearing 38 and intermediate bearing 39 are commercially available items and each comprise an outer cylindrical brass bearing shell and an inner cylindrical synthetic rubber bearing surface bonded within the shell. A third bearing (not shown) is provided surrounding the shaft above the stuffing box 22 and is supported within a housing 40 removably secured to a housing support by means of bolts 41.

As mentioned in the section "Prior Art," numerous problems were associated with lower and intermediate bearings in pump installations. After continued use, the bearings would naturally wear and require periodic maintenance or replacement. However, in prior art pumps, removal of the lower and intermediate bearings was complicated and time consuming. For example, to remove the lower bearing, the impeller had to be removed which often meant the sump had to be dewatered. Removal of the intermediate bearing required the bearing to be of a type of cylindrical bearing which was axially split into two semi-cylindrical parts. However such split bearings were easily and require frequent replacement. The apparatus of the present invention overcomes both of these problems and permits use of a solid intermediate bearing and removal of the lower bearing without requiring removal of the impeller.

Figure 2:
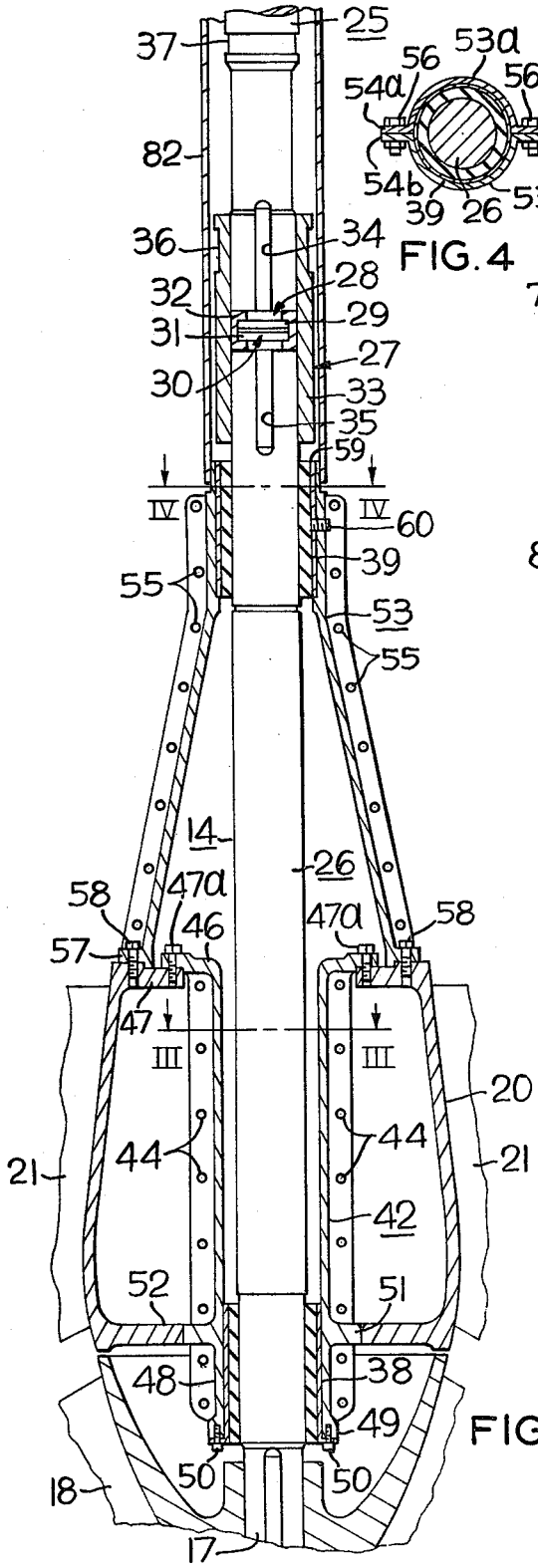
FIG. 2 is an enlarged view of a diffuser portion and intermediate coupling of the pump of FIG. 1.
Figure 3:
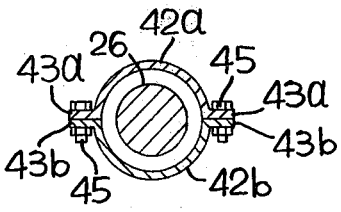
FIG. 3 is a view taken along line III—III of FIG. 2.

Referring now to FIGS. 2 and 3, a first bearing cartridge 42 is provided for supporting the lower bearing 38. First bearing cartridge 42 is comprised of two semi-cylindrical members, 42*a* and 42*b*, with members 42*a* and 42*b* having axially extending radially projecting flanges 43*a* and 43*b* respectively. Members 42*a* and 42*b* are joined to form a cylinder with flanges 43*a* abutting flanges 43*b*. The flanges are provided with axially aligned orifices 44 which receive bolts 45 securing members 42*a* and 42*b*. When joined, opposing surfaces of members 42*a* and 42*b* cooperate to define an orifice extending axially through cartridge 42 and sized to accept lower shaft 26.

A flanged upper end 46 of first cartridge 42 is secured to an upper end 47 of diffuser housing 20 by a plurality of bolts 47*a*. First bearing cartridge 42 extends downwardly from the flanged end 46 to a free end 48 surrounding first bearing 38. A lower flanged portion 49 of the brass bearing shell of first bearing 38 is removably secured to cartridge 42 by bolts 50. First cartridge 42 is provided with a radially outwardly projecting flange 51 circumferentially surrounding the cartridge opposite first bearing 38. The diffuser housing 20 is provided with a radially inwardly projecting flange 52 aligned in a plane with flange 51 and abutting flange 51. Flanges 51 and 52 are sized to have a close tolerance radial fit to prevent radial deflection of bearing 38.

Figure 4:
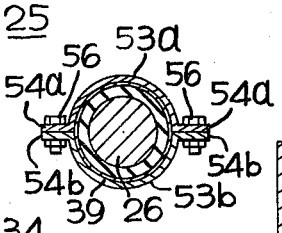
FIG. 4 is a view taken along line IV—IV of FIG. 2.

As shown in FIGS. 2 and 4, a second bearing cartridge 53 is provided for supporting second bearing 39 and comprises two semi-conical members 53*a* and 53*b* each having axially extending radially projecting flanges 54*a* and 54*b* respectively. Members 53*a* and 53*b* are joined to form a cone with flanges 54*a* abutting flanges 54*b* with orifices 55 within the flanges axially aligned and receiving bolts 56 securing members 53*a* and 53*b* together. When joined, opposing surfaces of members 53*a* and 53*b* cooperate to define a cavity extending axially through cartridge 53 sized to receive the lower shaft 26. A flanged lower or base end 57 of the cartridge 53 is secured to the housing 20 by a plurality of bolts 58 with the base end 57 of cartridge 53 surrounding the upper end of cartridge 42. Second cartridge 53 extends upwardly from the base end 57 to a free end 59 surrounding second bearing 39 with second bearing 39 removably secured to the free end 59 by means of a set screw 60.

Figure 5:
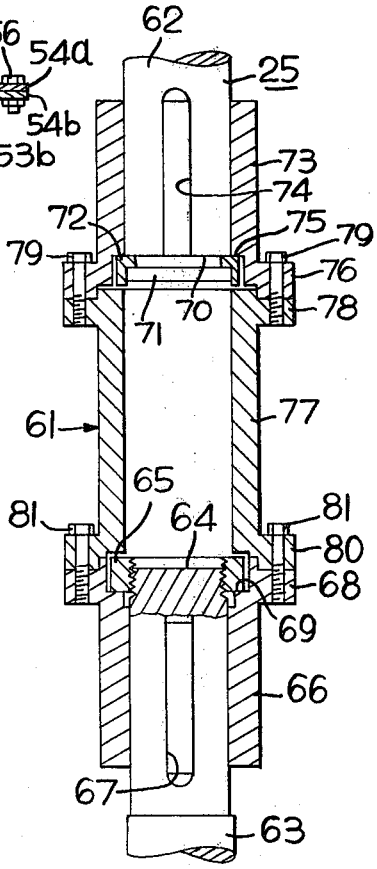
FIG. 5 is an enlarged detailed view of a spacer coupling of the pump of FIG. 1.

As shown in FIG. 1, upper shaft portion 25 is provided with a spacer coupling 61. Shown more fully in FIG. 5, spacer coupling 61 separates the upper shaft portion 25 into two portions with a first portion 62 extending downwardly from the motor and a second portion 63 extending upwardly from the intermediate coupling 27. An upper end 64 of second portion 63 is threaded and receives an internally threaded ring 65. A lower sleeve 66 is provided surrounding second portion 63 and keyed thereto by means of a keyway 67 with a flanged upper surface 68 of sleeve 66 abutting ring 65 as at 69.

A lower end 70 of first portion 62 is provided with an axially extending flanged hub 71. A split ring 72 is provided surrounding hub 71 with a notch within the ring receiving the flanged portion of hub 71 with the flanged hub supporting the ring. Ring 72 is axially split to facilitate removal of the ring. An upper sleeve 73 is provided surrounding first portion 62 and keyed thereto by means of a keyway 74. Sleeve 73 abuts split ring 72 as at 75 with ring 72 supporting sleeve 73 and preventing sleeve 73 from dropping. Sleeve 73 is provided with a flanged lower end 76. A flanged spacer pipe 77 having an axial dimension greater than the axial dimensions of first bearing 38 and second bearing 39 is provided between upper sleeve 73 and lower sleeve 66. An upper flange 78 of pipe 77 abuts the lower flange 76 of upper sleeve 73 and is secured thereto by bolts 79. Likewise a lower flange 80 of pipe 77 abuts the upper flange 68 of lower sleeve 66 and is secured thereto by bolts 81.

In operation, shaft 14 is isolated from water within the passageway by means of a shaft tube 82 removably secured to stuffing box 22 and surrounding the shaft 14. The tube 82 extends downwardly through opening 15 in casing 10 and terminates abutting second cartridge 53 in sealing engagement as shown in FIG. 2.

Through continued operation, first bearing 38 and second bearing 39 wear and require replacement. The novel apparatus of the present invention permits replacement of first bearing 38 without the need for removal of the impeller 18. Additionally, second bearing 39 may be a solid bearing compared to previously required split bearings having shorter lives. The method by which the bearings may be removed will be described with reference to FIG. 1 and sequential FIGS. 6, 7 and 8.

To remove first and second bearings 38 and 39, spacer pipe 77 is removed by removing bolts 81 and 79 securing the pipe 77 to upper sleeve 73 and lower sleeve 66 of space coupling 61. With pipe 77 removed, threaded ring 65 may be removed from second portion 63 of upper shaft 25. With ring 65 removed, the lower sleeve 66 may be slid along keyway 67 and removed.

Figures 6, 7, 8, 9:
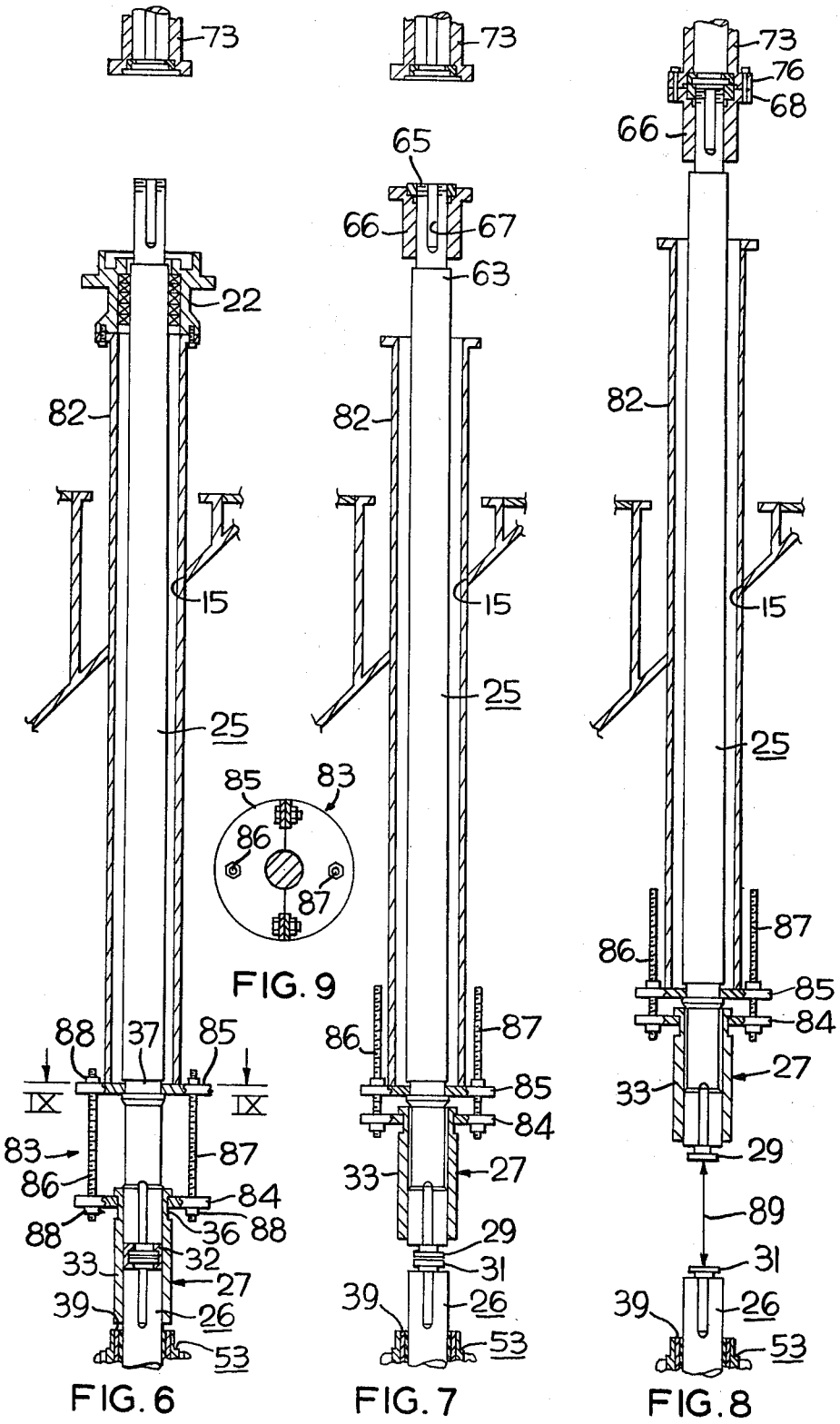
FIGS. 6, 7 and 8 are sequential views showing the preparation of the pump for the removal of bearings of the pump of FIG. 1.
FIG. 9 is a view taken along line IX—IX of FIG. 6.

With lower sleeve 66 removed, bearing housing 40 may be removed from its brace by removing bolts 41 and sliding the housing 40 with its contained bearing upward and removing the housing 40 through gap caused by removal of spacer pipe 77. The stuffing box 22 may next be removed from its brace 23 and moved upwardly carrying tube 82 upwardly to expose intermediate coupling 27. A worker may now enter passageway 11 through manhole 24 and install a coupling sleeve removing tool 83 with the apparatus now presenting the arrangement shown in FIG. 6. As shown in FIGS. 6 and 9, tool 83 comprises two rings 84 and 85 which are each axially split. Ring 85 is joined around upper shaft 25 at notch 37 and bears against shaft 25 within notch 37. Similarly, ring 84 is joined around coupling sleeve 33 and received within notch 36 bearing against the sleeve. Threaded rods 86 and 87 are received through aligned orifices in rings 84 and 85 and secured by nuts 88. Thus arranged, tool 83 may be used to lift sleeve 33 by sequentially turning nuts 88 on rods 86 and 87 drawing ring 84 and sleeve 33 toward ring 85.

With tool 83 in place, the stuffing box 22 may be removed from tube 82 and lower sleeve 66 of space coupling 61 replaced along with threaded ring 65. Tool 83 is now worked to draw sleeve 33 upwardly to expose split ring 32 and the split ring may be removed thus presenting the arrangement in FIG. 7.

The lower portion of upper shaft 25 may now be lifted upwardly and lower sleeve 66 of coupling 61 may be secured to the upper sleeve 73 as shown in FIG. 8. With upper and lower sleeves 66 and 73 joined, a gap 89 is presented between upper and lower shafts 25 and 26 equal to the axial dimension of spacer pipe 77.

With gap 89 presented, second cartridge 53 may be removed from diffuser housing 20 and members **53*a* and 53*b* split to expose second bearing 39 which may be slid along shaft 26 to gap 89 and removed. With second bearing 39 removed, bolts 47*a* securing the upper end 46 of first cartridge 42 to housing 20 may be removed and first cartridge 42 may be lifted out of the housing 20 with the cartridge carrying the first bearing 38 upwardly along the shaft 26. With the first cartridge 42 removed from the housing 20, members 42*a* and 42*b* may be split by removing bolts 44 and bolts 50 exposing first bearing 38 which may now be removed from the shaft through gap 89**. First and second bearings may now be replaced by reversing the above described procedure.

From the foregoing, it can be seen that the present invention has achieved the objective of providing a vertical pump with a lower bearing which can be removed without removal of the pump impeller and having an intermediate bearing which may be solid rather than split.

Modifications and equivalents of the disclosed concepts such as readily occur to those skilled in the art are intended to be included in the scope of the invention. Thus, the scope of the invention is intended to be limited only by the scope of the claims such as or may hereafter be, appended hereto.

The embodiments of the invention in which an exclusive property or privilege is claimed are defined as follows:

1. A hydraulic pump installation having a water passageway defined by a pump casing; an impeller within said water passageway; a rotary shaft including separable first and second shaft portions carrying said impeller and operably connecting said impeller to a pump motor with at least a portion of said shaft being disposed within said passageway; a first cylindrical bearing surrounding said shaft adjacent said impeller;

a diffuser surrounding said shaft adjacent said impeller and spaced from said shaft; said diffuser having a plurality of diffuser vanes extending therefrom and secured to said casing; a first bearing cartridge comprising a plurality of separable members adapted to be joined with opposing surfaces of said members defining a shaft receiving orifice extending through said first cartridge; said first cartridge sized to be received within said diffuser with said shaft extending through said orifice; means for removably securing said cartridge to said diffuser on a side of said diffuser remote from said impeller with said cartridge extending toward said impeller and terminating at a free end; means for removably securing said first bearing to said free end;

coupling means for accommodating separation of said first and second shaft portions with said first portion extending from said motor and said second portion extending from said impeller; means for moving said first portion away from said second portion an amount sufficient to provide a gap between said first and second portions with said gap between said portions being of a distance greater than an axial dimension of said first bearing whereby first bearing may be removed from said support and moved along said second portion to said gap and removed through said gap whereby said cartridge may be removed from said diffuser and moved along said shaft and away from said impeller with said cartridge carrying said first bearing and said plurality of members may be separated exposing said first bearing accommodating removal of said first bearing.

2. A hydraulic pump installation according to claim 1 wherein said cartridge is provided with a radially outwardly projecting flange proximate said free end and said diffuser is provided with a radially inwardly projecting flange aligned surrounding said outwardly projecting flange in close tolerance thereto.

3. A hydraulic pump installation according to claim 1 wherein said means for moving said first shaft portion away from said second shaft portion comprises a spaced coupling included within said first shaft portion; said spaced coupling having a removable shaft member having an axial dimension greater than said axial dimension of said first bearing.

4. A hydraulic pump installation according to claim 3 having a second bearing surrounding said second shaft proximate said coupling means connecting said first and second shaft portions wherein said second bearing is cylindrical having an axial dimension less than said axial dimension of said shaft member of said spaced coupling.

5. A hydraulic pump installation according to claim 4 having a second bearing cartridge comprising a plurality of separable members adapted to be joined with opposing surfaces of said members defining a shaft receiving cavity extending through said second cartridge; means for removably securing said second cartridge to said diffuser with second shaft extending through said cavity and with said cartridge extending from said diffuser away from said impeller and terminating at a free end proximate said second bearing; means for removably securing said second bearing to said free end.

6. A hydraulic pump installation according to claim 5 wherein said shaft is disposed with a generally vertical axis of rotation with said second shaft portion beneath said first shaft portion.

* * * * *